US012404670B2

(12) United States Patent
Seikaly

(10) Patent No.: US 12,404,670 B2
(45) Date of Patent: Sep. 2, 2025

(54) MULTI-LAYERED STRUCTURAL AND MATERIAL SYSTEM ASSEMBLY

(71) Applicant: Abeer Seikaly, Amman (JO)

(72) Inventor: Abeer Seikaly, Amman (JO)

( * ) Notice: Subject to any disclaimer, the term of this patent is extended or adjusted under 35 U.S.C. 154(b) by 559 days.

(21) Appl. No.: 17/765,739

(22) PCT Filed: Oct. 1, 2020

(86) PCT No.: PCT/JO2020/050009
§ 371 (c)(1),
(2) Date: Mar. 31, 2022

(87) PCT Pub. No.: WO2021/064763
PCT Pub. Date: Apr. 8, 2021

(65) Prior Publication Data

US 2022/0403645 A1 Dec. 22, 2022

Related U.S. Application Data

(60) Provisional application No. 62/909,170, filed on Oct. 1, 2019.

(51) Int. Cl.
*E04B 1/32* (2006.01)

(52) U.S. Cl.
CPC ..... *E04B 1/3211* (2013.01); *E04B 2001/3223* (2013.01); *E04B 2001/3276* (2013.01)

(58) Field of Classification Search
CPC ..... E04B 1/3211; E04B 2001/3276; E04B 2001/3223; E04B 2001/3258; E04B 2001/327
USPC ..... 52/63, 80.2, 81.1–81.6, 648.1, 653.1, 52/654.1, 655.1, 653.2
See application file for complete search history.

(56) References Cited

U.S. PATENT DOCUMENTS 2,682,235 A * 6/1954 Fuller ..... E04B 1/3211 52/630
3,203,144 A * 8/1965 Fuller ..... E04B 1/3211 52/537

(Continued)

OTHER PUBLICATIONS

International Search Report mailed on Jan. 29, 2021 in PCT/JO2020/050009 filed on Oct. 1, 2020 (4 pages).

(Continued)

*Primary Examiner* — Brian E Glessner
*Assistant Examiner* — Adam G Barlow
(74) *Attorney, Agent, or Firm* — Oblon, McClelland, Maier & Neustadt, L.L.P.

(57) ABSTRACT

A multi-layered structural and material system assembly may include a first layer and a second layer, each of the first layer and second layer comprises a plurality of slender structural support elements, wherein a plurality of anchoring members connects the first layer to the second layer to form a skeleton of the multi-layered structural and material system assembly; and a fabric harmoniously integrated into a substantial part of the skeleton to define a plurality of singular modules, wherein the skeleton comprises a plurality of unit cells arranged in a repeating pattern, each having a first central axis and a second central axis, each unit cell of the plurality of unit cells in the first layer is in a horizontal offset displacement of a corresponding unit cell of the plurality of unit cells of the second layer.

29 Claims, 14 Drawing Sheets

(56) References Cited

U.S. PATENT DOCUMENTS 3,220,152 A * 11/1965 Sturm ..... E04B 1/19 D25/13
3,325,958 A * 6/1967 Moore ..... E04B 7/105 52/63
3,359,694 A * 12/1967 Hein ..... E04B 1/3211 52/81.3
3,807,421 A * 4/1974 Geiger ..... E04H 15/18 D25/4
3,830,031 A * 8/1974 Soisson ..... E04B 1/3441 52/645
4,113,206 A * 9/1978 Wheeler ..... B64B 1/08 52/63
4,542,759 A * 9/1985 Kyner, Jr. ..... E04B 1/3211 52/81.3
5,036,635 A * 8/1991 Lalvani ..... E04B 1/1906 52/80.1
5,072,553 A * 12/1991 Bozetto ..... E04H 5/12 261/DIG. 11
5,155,951 A * 10/1992 Lalvani ..... A63H 33/04 52/80.2
5,440,840 A * 8/1995 Levy ..... E04B 7/14 52/63
5,505,035 A * 4/1996 Lalvani ..... B64G 99/00 52/311.2
6,134,848 A * 10/2000 Walter ..... E04H 15/644 52/83
7,591,108 B2 * 9/2009 Tuczek ..... E04B 7/102 52/80.1
8,522,505 B2 * 9/2013 Beach ..... E04B 5/023 403/92
8,839,588 B2 * 9/2014 Philbin ..... F16B 1/00 52/715
11,486,129 B1 * 11/2022 Garvey ..... F16B 2/04
11,773,581 B2 * 10/2023 Smith ..... E04C 3/06 52/63
2019/0390454 A1 * 12/2019 Kalenak ..... E04B 1/3211
2024/0175252 A1 * 5/2024 Lee ..... E04B 1/3211

OTHER PUBLICATIONS

Seikaly, A., "abeer seikaly weaves shelters for disaster relief using patterned fabric", retrieved from internet; Mar. 30, 2022, https://www.designboom.com/architecture/abeer-seikaly-weaving-a-home-disaster-relief-03-06-2014/, total 16 pages.

* cited by examiner

MULTI-LAYERED STRUCTURAL AND MATERIAL SYSTEM ASSEMBLY

CROSS-REFERENCE TO RELATED APPLICATIONS

This application is the national stage of international application PCT/JO2020/050009, filed on Oct. 1, 2020, and claims the benefit of the filing date of claims priority to the U.S. Provisional Patent Application No. 62/909,170 filed on Oct. 1, 2019, each of which is herein incorporated by reference.

TECHNICAL FIELD

The present disclosure relates to structural systems in general, and more particularly to multi-layered structural and material system assemblies comprising structural elements and a fabric that can be harmoniously integrated into each other.

BACKGROUND

Multi-layered structural and material system assemblies are well-known in the art and can be used in a multitude of applications, such as shelters, facades, partitions, etc.

For instance, previous publications made by the inventor of the present technology disclose a double-layered foldable tent that includes an anterior layer and a posterior layer. The double-layered foldable tent can be used as shelter for emergency situations. The multi-layered foldable tent is formed of a plurality of structural elements connected to each other in a predetermined geometrical pattern such that they form sets of singular modules. The singular modules are organized in an array of columns and rows, wherein odd numbered rows contain a double layer and the even numbered rows contain a single layer of the singular modules that connect the anterior and posterior layers together. In odd numbered rows, the singular modules in the posterior and anterior layers are parallel and mirror images of one another. After conducting structural analysis and building the form in the way the concept was designed, the structural composition and geometrical configuration were not viable structurally.

SUMMARY

Therefore, it is an object of the present disclosure to provide a multi-layered structural and material system assembly that is stable under both static and dynamic load conditions through its geometry and topology.

Aspects of the present disclosure provide a multi-layered structural and material system assembly comprising:

a first layer and a second layer, each of the first layer and second layer comprises a plurality of slender structural support elements, wherein a plurality of anchoring members connects the first layer to the second layer to form a skeleton of the multi-layered structural and material system assembly, and a fabric harmoniously integrated into a substantial part of the skeleton to define a plurality of singular modules, wherein the skeleton comprises a plurality of unit cells arranged in a repeating pattern, each having a first central axis and a second central axis, each unit cell of the plurality of unit cells in the first layer is in a horizontal offset displacement of a corresponding unit cell of the plurality of unit cells of the second layer.

In some aspects, each slender structural support element of the plurality of slender structural support elements may be continuous.

In some aspects, each slender structural support element of the plurality of slender structural support elements may be in a pre-stressed condition.

In other aspects, each slender structural support element of the plurality of slender structural support elements may be made of separate rods connected to each other by means of joints.

In aspects of the present disclosure, one or two anchoring members of the plurality of anchoring members may extend from two opposed points in one of the plurality of the unit cells in the first layer and may meet at one point of a corresponding offset unit cell of the plurality of the unit cells in the second layer.

Similarly, in aspects of the present disclosure, one or two anchoring members of the plurality of anchoring members may extend from two opposed points in one of the plurality of the unit cells in the second layer and may meet at one point of a corresponding offset unit cell of the plurality of the unit cells in the first layer.

In some aspects, each anchoring member of the plurality of the anchoring members may be connected to other anchoring members of the plurality of the anchoring members by means of joints.

In aspects of the present disclosure, each element of the plurality of the slender structural support elements is connected to other slender structural support elements of the plurality of the slender structural support elements by means of joints.

In aspects of the present disclosure, the plurality of the slender structural support elements may be connected to the plurality of the anchoring members by means of joints.

In aspects of the present disclosure, each of the plurality of unit cells may be foldable against the first and/or second central axes.

In some aspects, each unit cell of the plurality of unit cells may have a similar size of other unit cells of the plurality of unit cells.

In some aspects, each unit cell of the plurality of the unit cells may have a similar shape to other unit cells of the plurality of unit cells.

In other aspects, each unit cell of the plurality of the unit cells may have a different shape than other unit cells of the plurality of unit cells.

In other aspects of the present disclosure, the plurality of unit cells may have different sizes.

In aspects of the present disclosure, the plurality of singular modules of the first layer may be oriented in an opposed direction to the singular modules of the second layer.

In some aspects of the present disclosure, the plurality of slender structural support elements may be hollow.

In other aspects, the plurality of slender structural support elements may be solid.

In yet some aspects of the present disclosure, the plurality of anchoring members may be hollow.

In yet other aspects of the present disclosure, the plurality of anchoring members may be solid.

In aspects of the present disclosure, the plurality of slender structural support elements may be made of a rigid material, a flexible material, or a combination thereof.

In some aspects, the plurality of slender structural support elements may be made of metal, plastic, bamboo, wood, fiberglass, carbon fiber or combinations thereof.

In aspects of the present disclosure, the plurality of anchoring members may be made of metal, plastic, bamboo, wood, fiberglass, or combinations thereof.

In aspects of the present disclosure, the fabric may be made of a natural material, man-made industrial material, or a combination thereof.

In some aspects, the natural material may be a composite material that may be made of an animal source, a plant source, or a combination thereof.

In some aspects, the composite material may be made of goat hair, wool, jute, felt, cotton, flax, hemp, or combinations thereof.

In some aspects, the man-made industrial material may include polyurethane-coated lycra, polyurethane coated spandex, ripstop nylon, polypropylene, graphene, synthetic fibers, Kevlar, polyester, plastic fibers, nylon, Cuben fiber, aramids, filament tape, or combinations thereof.

In aspects of the present disclosure, the fabric may be woven and/or knitted and/or spun and/or molded to provide a metamaterial capable of elastic deformation, or a non-stretchable material containing a multitude of patterns connected to each other.

In other aspects, the plurality of slender structural support elements and the plurality of anchoring members may bend under pre-stressed conditions to take a shape of a predetermined patterned fabric.

In aspects of the present disclosure, the horizontal offset displacement may be parallel to either the first central axis or the second central axis.

BRIEF DESCRIPTION OF THE DRAWINGS

The disclosure will now be described with reference to the accompanying drawings, which illustrate embodiments of the present disclosure, without however restricting the scope of the disclosure thereto, and in which.

DETAILED DESCRIPTION

For the sake of simplicity, the description hereunder is made with reference to a few number of slender structural support elements, unit cells, anchoring members, and singular modules. However, it should be acknowledged that the number and dimensions of the slender structural support elements, unit cells, anchoring members, and singular modules may be extended to form a skeleton for the multi-layered structural and material system assembly of the present disclosure. The number and dimensions of the slender structural support elements and singular modules merely depends on the application and the space where the system of the present disclosure is to be implemented or deployed. Also, the type of the fabric used merely depends on the application of the system of the present disclosure.

Furthermore, the description hereunder and the drawings are made with reference to a first layer and a second layer of the multi-layered structural and material system assembly of the present disclosure. However, it should be acknowledged that the multi-layered structural and material system assembly of the present disclosure may include more than two layers, which merely depends on the application of the system of the present disclosure.

The singular forms "a," "an," and "the" include plural referents unless the context clearly dictates otherwise.

The term "Fabric" as used herein may refer to any material that can be integrated into the system of the present disclosure by means of weaving, knitting, spinning, molding, or combinations thereof.

FIGS. 1-3 illustrate a multi-layered structural and material system assembly configured in accordance with embodiments of the present disclosure. The multi-layered structural and material system assembly may include a plurality of slender structural support elements 1, a plurality of anchoring members 2, arranged in a predetermined geometrical pattern to form a skeleton of the system, and a fabric 3, wherein the fabric 3 may be harmoniously integrated into a substantial part of the plurality of slender structural support elements 1 and the plurality of anchoring members 2 to form a plurality of singular modules 4.

Reference is now being made to FIGS. 1A-1F, 3A-3D. In some embodiments of the present disclosure, each of the plurality of slender structural support elements 1 may be formed of discrete members connected to each other by means of joints and may be pre-stressed, while in other embodiments, each of the plurality of slender structural support elements 1 may be continuous and may be deployed in the multi-layered structural and material system assembly under pre-stressed conditions.

Figure 1A:
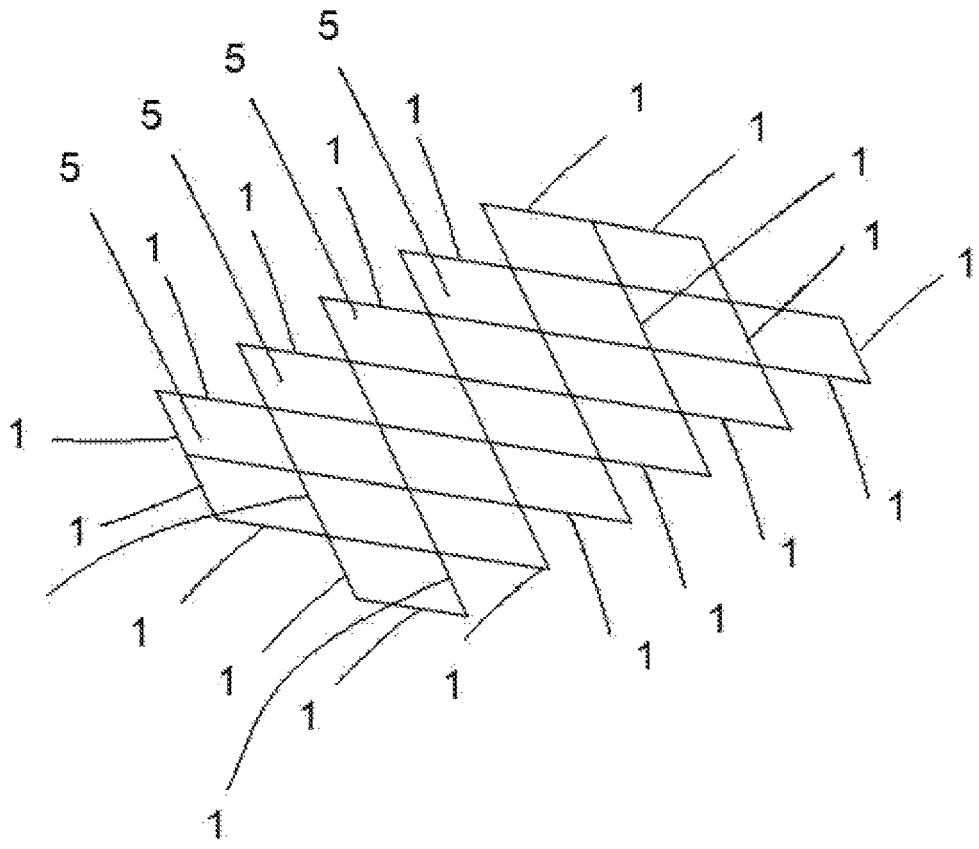
FIG. 1A illustrates a perspective view of an exemplary plurality of slender structural support elements forming a plurality of unit cells in a repeating pattern for a first layer of a multi-layered structural and material system assembly configured in accordance with embodiments of the present disclosure.
Figure 1B:
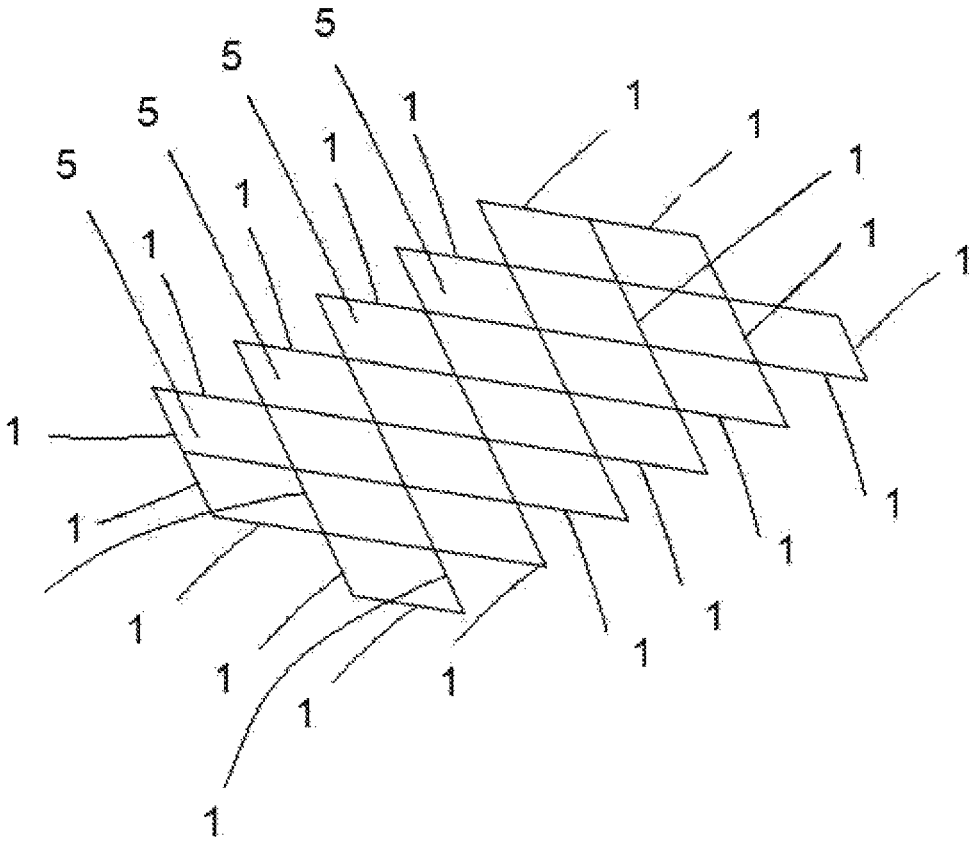
FIG. 1B illustrates a perspective view of an exemplary plurality of slender structural support elements forming a plurality of unit cells in a repeating pattern for a second layer of a multi-layered structural and material system assembly configured in accordance with embodiments of the present disclosure.
Figure 1C:
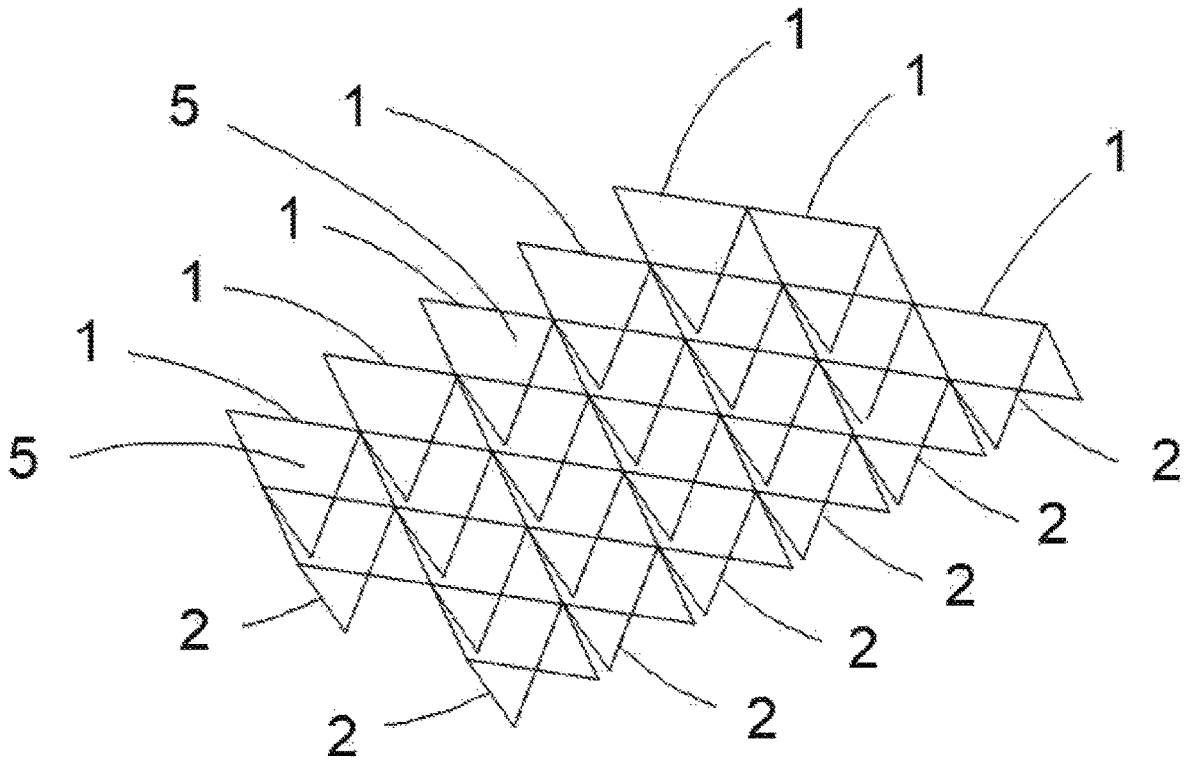
FIG. 1C illustrates a perspective view of an exemplary plurality of anchoring members connected to exemplary plurality of slender structural support elements of a first layer of a multi-layered structural and material system assembly configured in accordance with embodiments of the present disclosure.
Figure 1D:
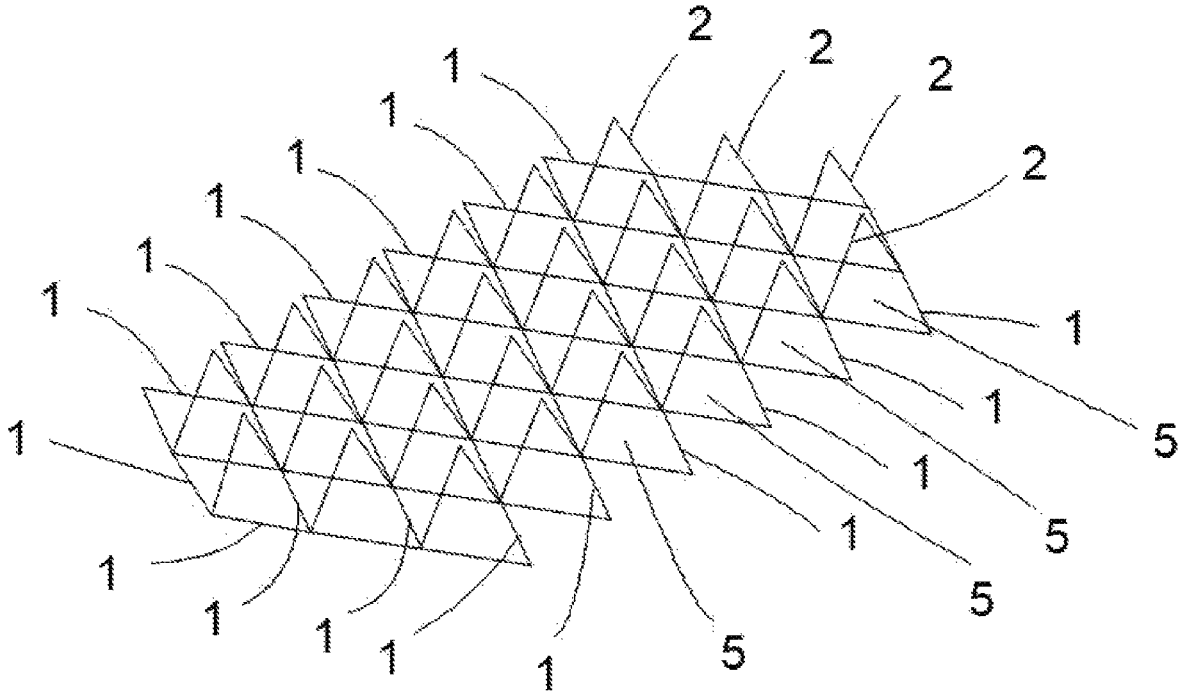
FIG. 1D illustrates a perspective view of an exemplary plurality of anchoring members connected to an exemplary plurality of slender structural support elements of a second layer of a multi-layered structural and material system assembly configured in accordance with embodiments of the present disclosure.
Figure 1E:
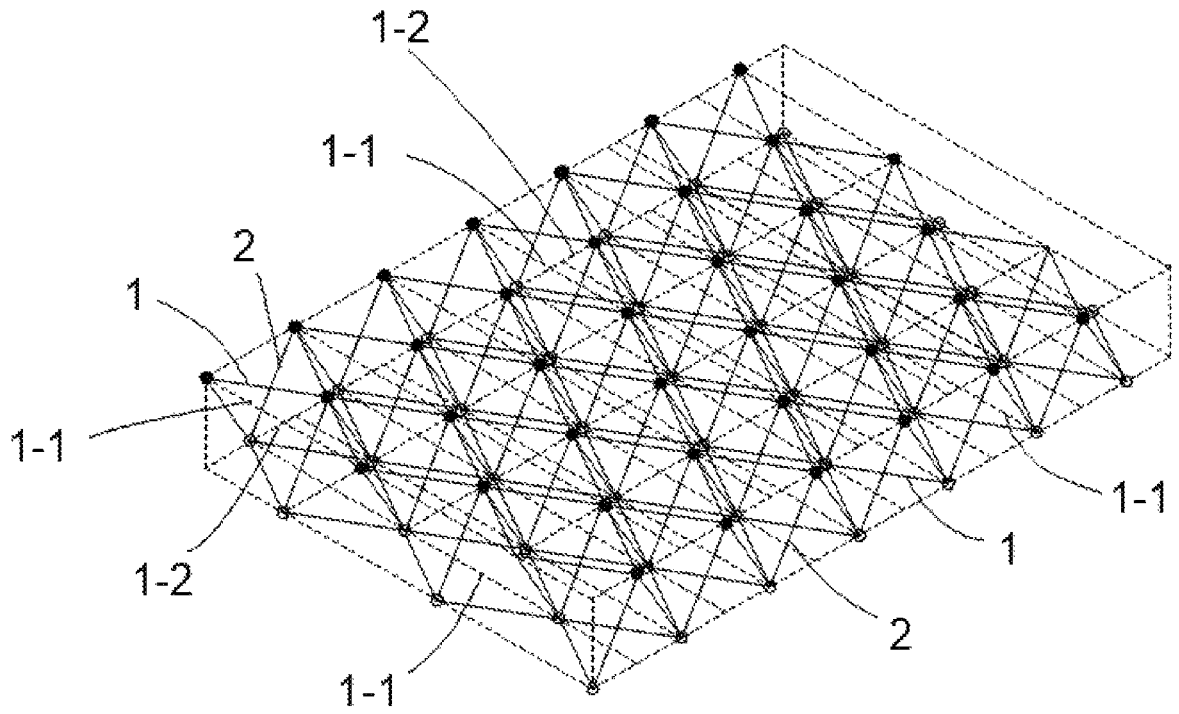
FIG. 1E illustrates a schematic block showing a perspective view of an exemplary a plurality of anchoring members connecting an exemplary plurality of slender structural support elements and of a first layer to an exemplary plurality of slender structural support elements of a second layer in a multi-layered structural and material system assembly configured in accordance with embodiments of the present disclosure.
Figure 1F:
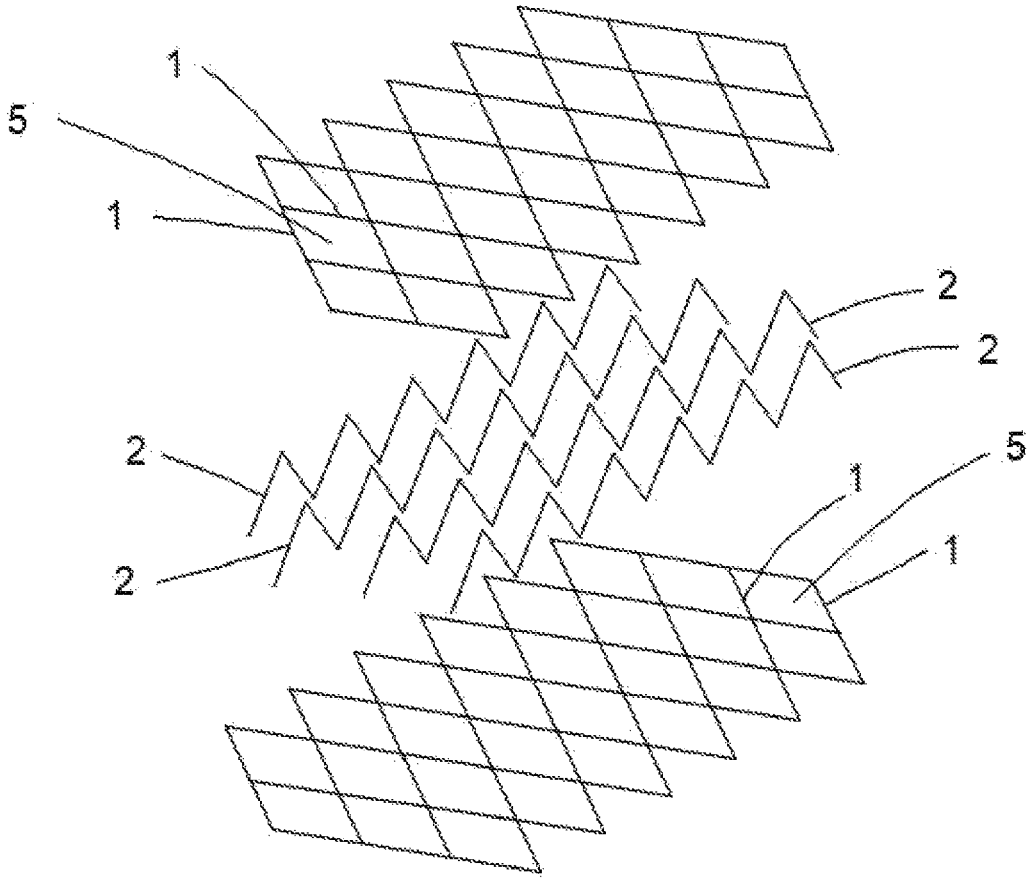
FIG. 1F illustrates an exploded perspective view of a first layer and a second layer in a multi-layered structural and material system assembly configured in accordance with embodiments of the present disclosure.
Figure 1G:
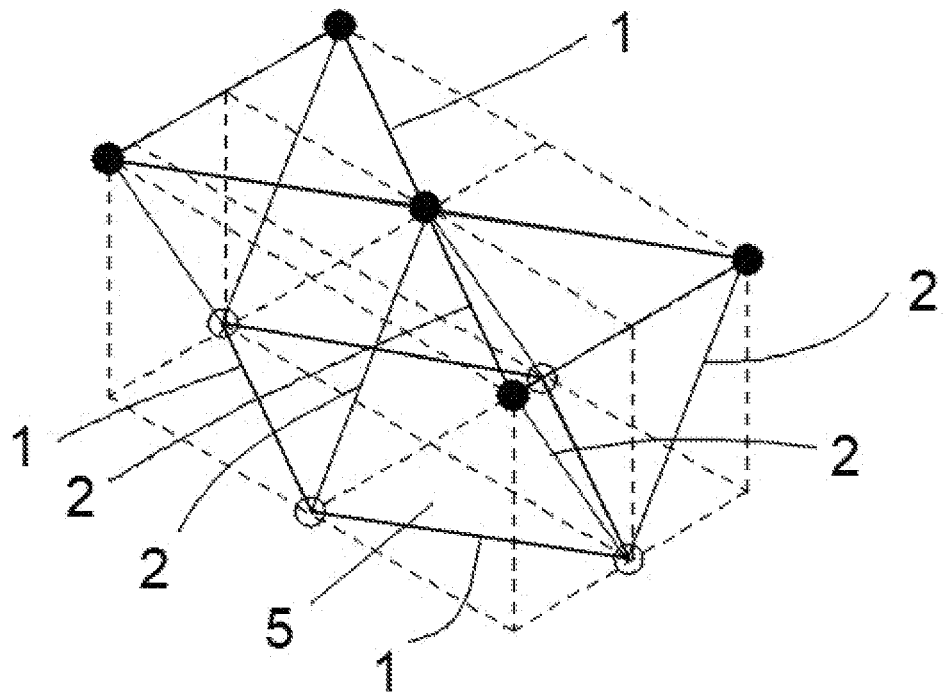
FIG. 1G illustrates a schematic block that shows a horizontal offset displacement of a unit cell in a second layer with reference to a corresponding unit cell in a second layer in a multi-layered structural and material system assembly configured in accordance with embodiments of the present disclosure.

In a first layer of the multi-layered structural and material system assembly of the present disclosure, the plurality of slender structural support elements 1 may be arranged in a two-dimensional array matrix comprising a plurality of unit cells 5 arranged in a repeating pattern (FIGS. 1A, 1B). The repeating unit cell pattern of a second layer may be in a horizontal offset displacement to the repeating unit cell pattern of the first layer (FIGS. 1E, 1G). The horizontal offset displacement may be parallel to either the central axis 1-1 or the central axis 1-2 (FIG. 1E). In FIGS. 1E, 1G, the points where the plurality of the slender structural support elements 1 in the first layer meet the plurality of the anchoring members 2 are represented by a full black circle, while the points where the plurality of the slender structural support elements 1 in the second layer meet the plurality of the anchoring members 2 are represented by an empty circle.

In some embodiments of the present disclosure, each of the plurality of unit cells 5 may have a rhombus shape (FIGS. 1A-1G), while in other embodiments, it may have an ogee shape (FIGS. 3A-3D). In yet other embodiments, each of the plurality of unit cells 5 may have any other symmetrical or asymmetrical shape.

In some embodiments, each unit cell of the plurality of the unit cells 5 may have a similar shape of other unit cells of the plurality of unit cells 5.

In other embodiments, each unit cell of the plurality of the unit cells may have a different shape than other unit cells of the plurality of unit cells.

In embodiments of the present disclosure, the plurality of anchoring members 2 may connect the first layer and the second layer together, thus providing a three-dimensional array matrix made of the plurality of anchoring members 2 and the plurality of slender structural support elements 1 (FIG. 1E).

In some embodiments, two anchoring members of the plurality of anchoring members 2 may extend from two opposed points of one of the plurality of the unit cells 5 in the first layer (FIG. 1C) and meet at one point of the corresponding offset unit cell of the plurality of the unit cells 5 in the second layer (FIGS. 1E, 1G). Similarly, two anchoring members of the plurality of anchoring members 2 may extend from two opposed points of one of the plurality of the unit cells 5 in the second layer (FIG. 1D) and meet at one point of the corresponding offset unit cell of the plurality of the unit cells 5 in the first layer (FIGS. 1E, 1G). The connection between the anchoring members 2 and the plurality of slender structural system elements 1 of the first and second layers may be achieved by means of single degree-of-freedom or multi-degrees-of-freedom joints.

Figure 3A:
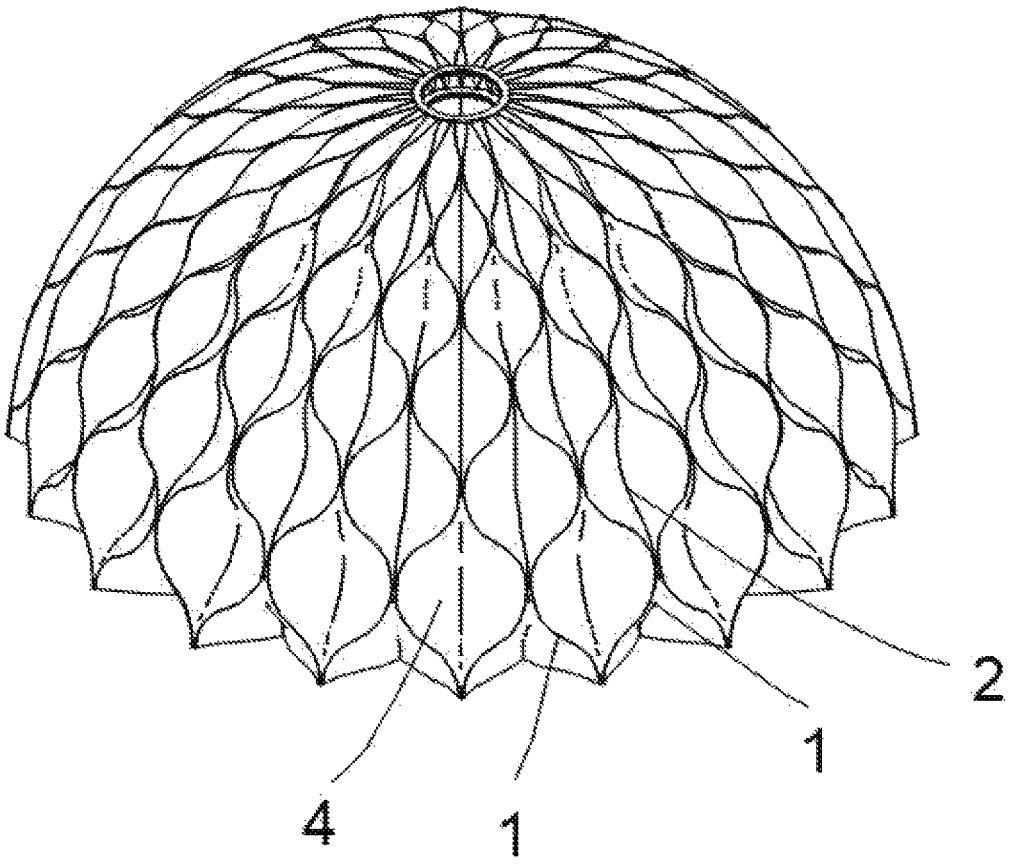
FIG. 3A illustrates a perspective view of a plurality of slender structural support elements and a plurality of anchoring members in a first layer of a double-layered dome-shaped structure implemented using a multi-layered structural and material system assembly configured in accordance with embodiments of the present disclosure.
Figure 3B:
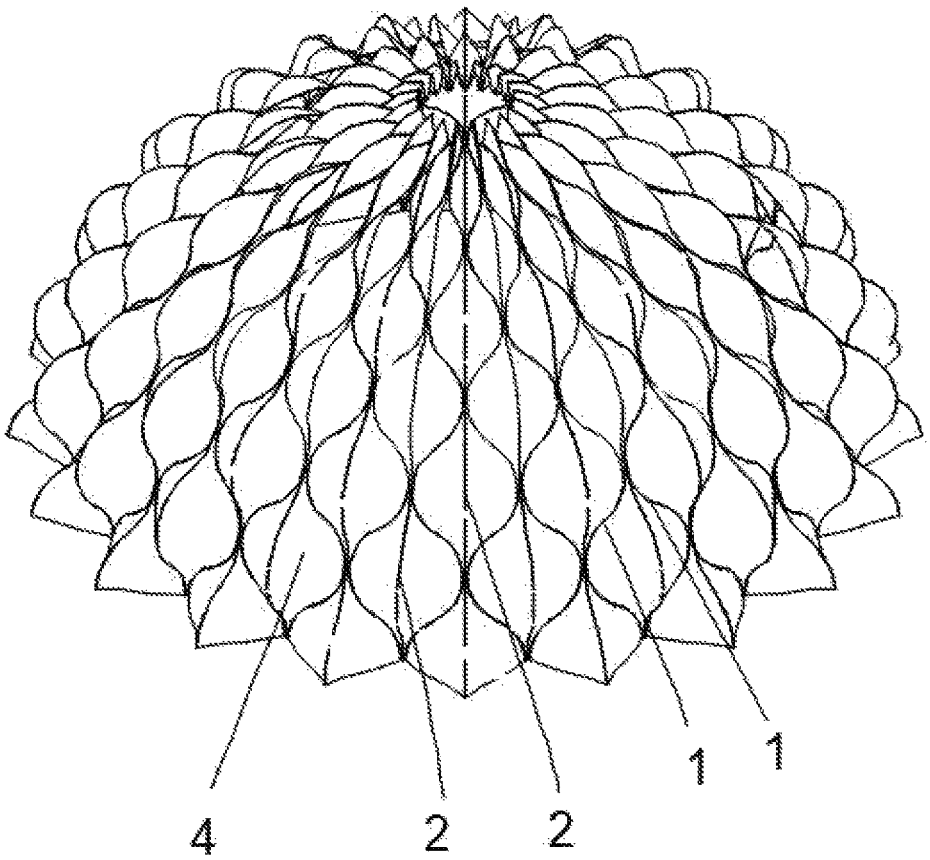
FIG. 3B illustrates a perspective view of a plurality of slender structural support elements and a plurality of anchoring members in a second layer of a double-layered dome-shaped structure implemented using a multi-layered structural and material system assembly configured in accordance with embodiments of the present disclosure.
Figure 3C:
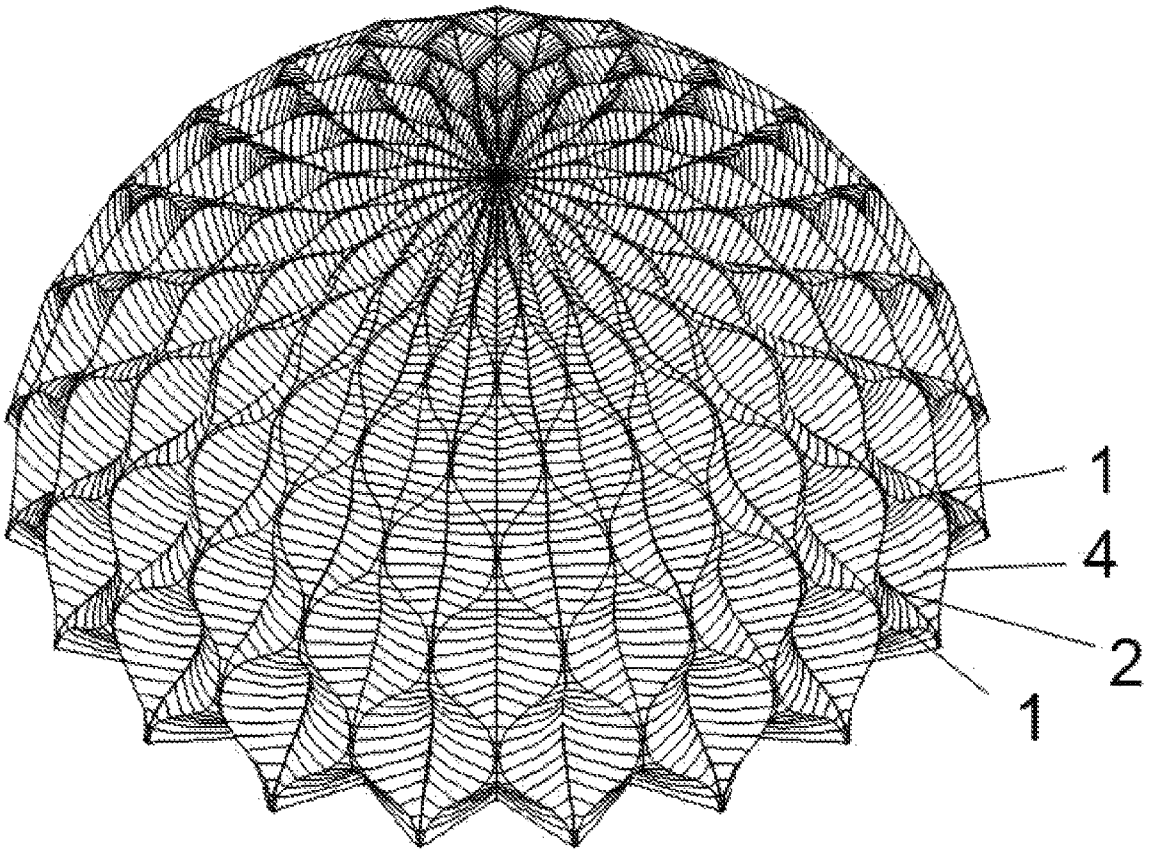
FIG. 3C illustrates a perspective view of a double-layered dome-shaped structure implemented using a multi-layered structural and material system assembly configured in accordance with embodiments of the present disclosure.
Figure 3D:
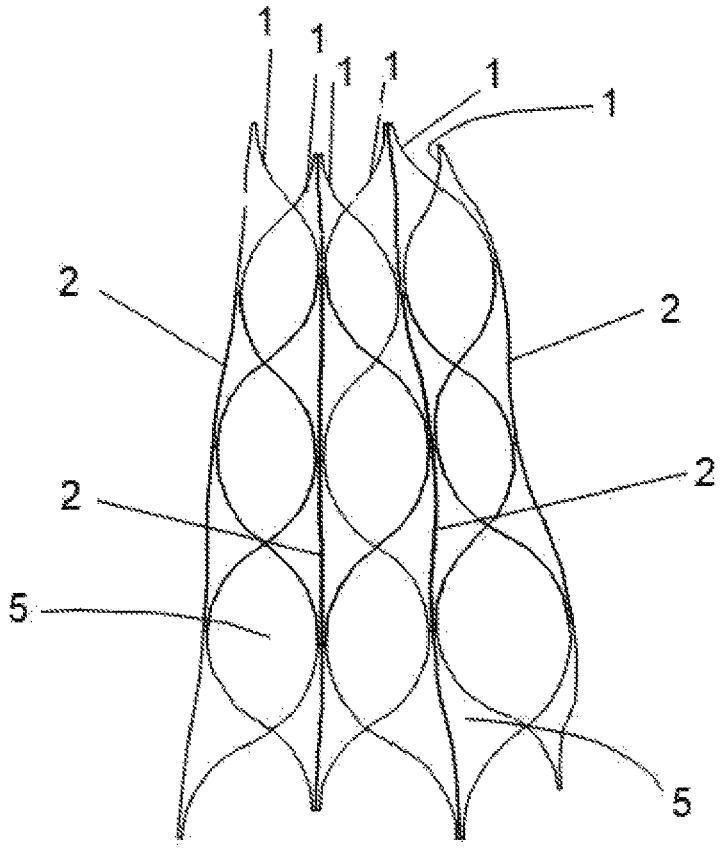
FIG. 3D illustrates a partial elevation front view of a plurality of slender structural support elements and a plurality of anchoring members in a first and second layers of a double-layered dome-shaped structure implemented using a multi-layered structural and material system assembly configured in accordance with embodiments of the present disclosure.

In other embodiments, only one anchoring member of the plurality of anchoring members 2 may extend under a pre-stressed condition from two opposed points of one of the plurality of the unit cells 5 in the first layer and meet at one point of the corresponding offset unit cell of the plurality of the unit cells 5 in the second layer (FIG. 3D). Similarly, only one anchoring member of the plurality of anchoring members 2 may extend under a pre-stressed condition from two opposed points of one of the plurality of the unit cells 5 in the second layer and meet at one point of the corresponding offset unit cell of the plurality of the unit cells 5 in the first layer (FIG. 3D). The connection between the anchoring member 2 and the plurality of slender structural system elements 1 of the first and second layers may be achieved by means of single degree-of-freedom or multi-degrees-of-freedom joints.

In some embodiments, all of the singular modules 4 may have similar volumetric sizes.

In other embodiments, the volumetric sizes of the singular modules 4 may be different, in order to accommodate for deployment of the system in radial configurations (FIGS. 3A-3D).

In some embodiments, the singular modules 4 may have a similar shape of other singular modules 4.

In other embodiments, each of the singular modules 4 may have a different shape than other singular modules 4.

In some embodiments of the present disclosure, the plurality of slender structural support elements 1 may be hollow, this allows for ducting electrical wiring and/or fluid plumbing through these elements.

In other embodiments, the plurality of slender structural support elements 1 may be solid.

In other embodiments, the plurality of slender structural support elements 1 and the plurality of anchoring members 2 may bend under pre-stressed conditions to take a shape of a predetermined patterned fabric 3.

Alternatively, the plurality of anchoring members 2 in some embodiments may be hollow, this allows for ducting electrical wiring and/or fluid plumbing through these members.

In other embodiments the plurality of anchoring members 2 may be solid.

In embodiments of the present disclosure, the plurality of slender structural support elements 1 may be made of any state-of-the-art rigid or flexible material including, but not limited to metals, plastic, bamboo, wood, fiberglass, carbon fiber, or combinations thereof.

In embodiments of the present disclosure, the plurality of anchoring members 2 may be made of any state-of-the-art rigid or flexible material including, but not limited to metals, plastic, bamboo, wood, fiberglass, carbon fiber, or combinations thereof.

Figure 2A:
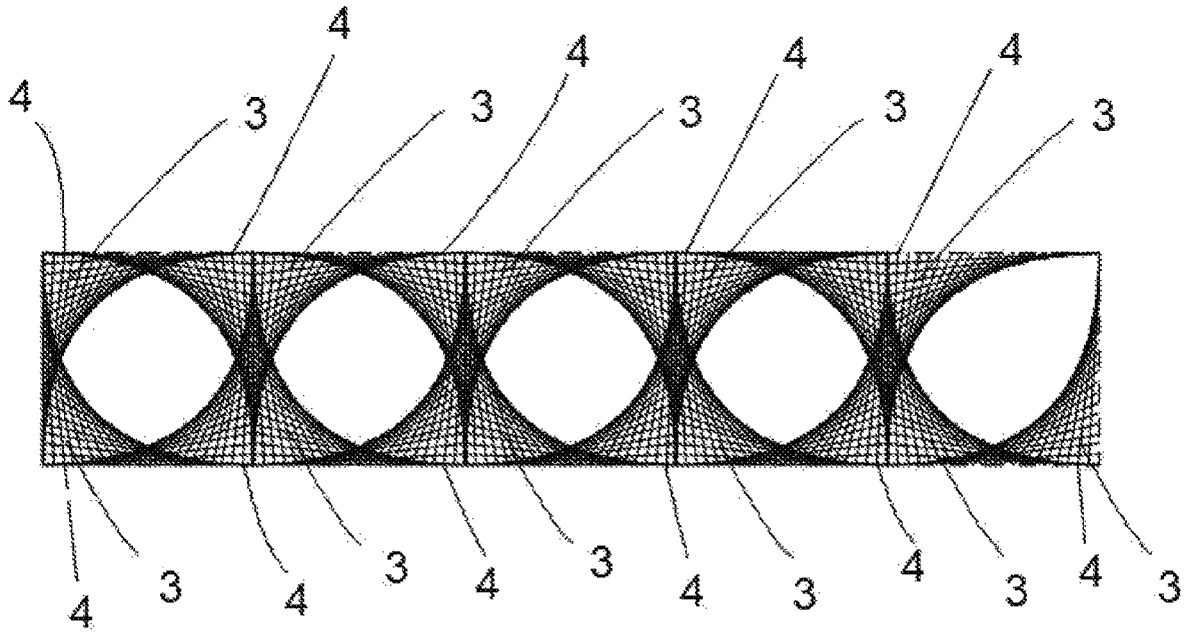
FIG. 2A illustrates a side view of a multi-layered structural and material system assembly with a fabric covering a substantial part of a plurality of singular modules, the multi-layered structural and material system assembly being configured in accordance with embodiments of the present disclosure.
Figure 2B:
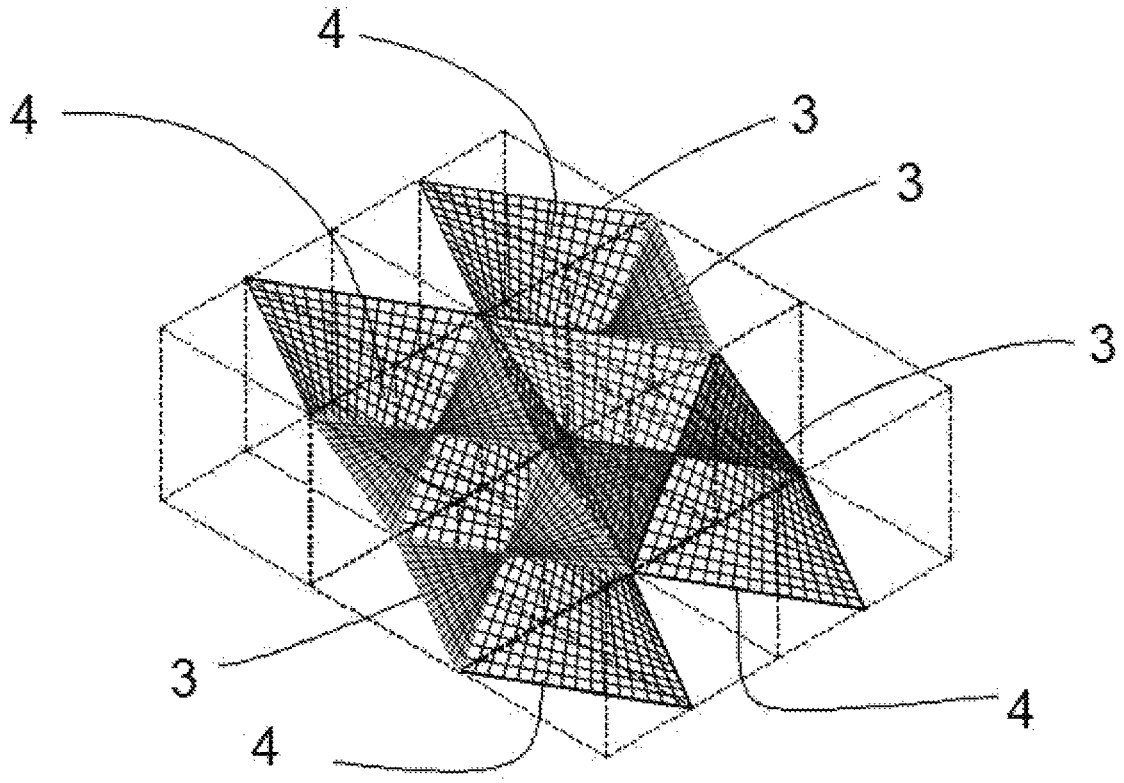
FIG. 2B illustrates a perspective view of a schematic block that shows a hyperbolic shape formed by a fabric covering a substantial part of a plurality of singular modules of a multi-layered structural and material system assembly configured in accordance with embodiments of the present disclosure.

Referring now to FIGS. 2A, 2B with continued reference to FIGS. 1E, 3C. In embodiments of the present disclosure, the fabric 3 may be configured to be harmoniously integrated into a substantial part of the plurality of slender structural support elements 1 and the plurality of anchoring members 2 in order to define a plurality of singular modules 4 having a hyperbolic paraboloid profile, i.e. a doubly-curved surface (FIGS. 2A, 2B, 3C). Each of the singular modules 4 may be foldable against a corresponding first central axis 1-1 and/or a second central axis 1-2 (FIG. 1E), this may be achieved by connecting the plurality of slender structural support elements 1 in each unit cell together using single degree-of-freedom joints or multi-degrees-of-freedom joints.

In embodiments of the present disclosure, the fabric 3 may be made of a man-made industrial material and/or a natural composite material.

In some embodiments, the fabric 3 may be woven and/or knitted and/or spun and/or molded in a pattern that provides elastic deformation capabilities, while in other embodiments, fabric 3 may be a non-stretchable material containing a multitude of patterns connected to each other in order to create a desired shape or form.

In some embodiments, the natural composite material may be made of an animal source, a plant source, or a combination thereof.

In some embodiments, the natural composite material may be made of goat hair, wool, jute, felt, cotton, flax, hemp, or combinations thereof.

In other embodiments, the man-made industrial material may include polyurethane-coated lycra, polyurethane coated spandex, ripstop nylon, polypropylene, graphene, synthetic fibers, Kevlar, polyester, plastic fibers, nylon, Cuben fiber, aramids, filament tape, or combinations thereof.

In embodiments of the present disclosure, the fabric 3 may be woven and/or knitted and/or spun and/or molded to provide a metamaterial capable of elastic deformation, or a non-stretchable material containing a multitude of patterns connected to each other.

The disclosure is now further illustrated on the basis of an example and a detailed description from which further features and advantages may be taken. It is to be noted that the following explanations are presented for the purpose of illustrating and description only; they are not intended to be exhaustive or to limit the disclosure to the precise form disclosed.

Example 1

Forming a Dome-Shaped Structure Using a Multi-layered Structural and Material System Assembly In this example, a double-layered dome structure resembling a tent, as illustrated in FIGS. 3A-3D. The geometry of the present dome-shaped structure capitalizes on the performative capacity of pre-stressed plurality of curved slender structural support elements linked together to form a stable and durable double-layered enclosure. The resulting lightweight structure is able to withstand varying climatic conditions, and may be adapted to collect water in the singular modules.

In the double-layered dome structure of this example, the fabric 3 was first knitted in the first place to have the desired shape of the plurality of singular modules 4 and dedicated passages for the plurality of slender structural support elements 1 and the plurality of anchoring members 2 were defined during the knitting process. After that, each of the plurality of slender structural support elements 1 and the plurality of anchoring members 2, that have straight shape, were inserted through the dedicated passages by pole-trusion. This forced the plurality of slender structural support elements 1 and the plurality of anchoring members 2 to bend under pre-stressed conditions. FIG. 3D illustrates a partial elevation front view of a plurality of slender structural support elements and a plurality of anchoring members in the first and second layers of the double-layered dome-shaped structure under pre-stressed conditions.

Figure 3E:
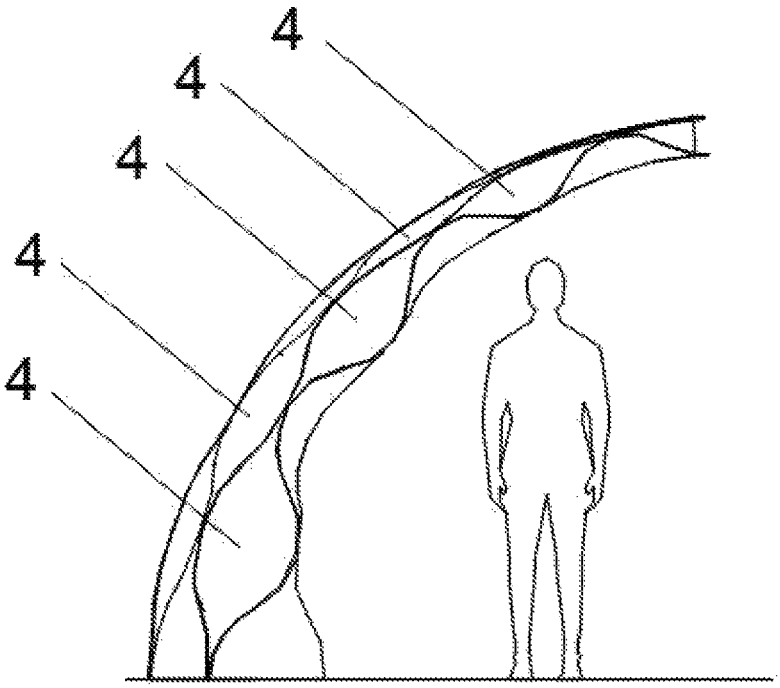
FIG. 3E illustrates a partial sectional view of a double-layered dome-shaped structure implemented using a multi-layered structural and material system assembly configured in accordance with embodiments of the present disclosure.

As illustrated in FIGS. 3A-3C, 3E the volumetric size of the singular modules 4 in the double-layered dome structure of this example decreases as going upwards toward the tip of the structure. The decrease of the volumetric size is a result of decreasing the width and depth of the singular modules 4 in both elevation and section in order to be able to form the dome shape, and due to fabrication and functional reasons (FIG. 3E).

While embodiments of the present disclosure have been described in detail and with reference to specific embodiments thereof, it will be apparent to one skilled in the art that various additions, omissions, and modifications can be made without departing from the spirit and scope thereof.

What is claimed is:

1. A multi-layered structural and material system assembly, comprising:

a first layer and a second layer, each of the first layer and second layer comprises a plurality of slender structural support elements, wherein a plurality of anchoring members connects the first layer to the second layer to form a skeleton of the multi-layered structural and material system assembly; and a fabric integrated within the first and second layers to define a plurality of singular modules, wherein the skeleton comprises a plurality of unit cells arranged in a repeating pattern, each having a first central axis and a second central axis, each unit cell of the plurality of unit cells in the first layer is in a horizontal offset displacement of a corresponding unit cell of the plurality of unit cells of the second layer, and wherein the plurality of singular modules of the first layer is oriented in an opposed direction to the singular modules of the second layer.

2. The assembly of claim 1, wherein each slender structural support element of the plurality of slender structural support elements is continuous.

3. The assembly of claim 1, wherein each slender structural support element of the plurality of slender structural support elements is in a pre-stressed condition.

4. The assembly of claim 1, wherein each slender structural support element of the plurality of slender structural support elements is made of separate rods connected to each other by joints.

5. The assembly of claim 1, wherein one or two anchoring members of the plurality of anchoring members connect two opposed points in one of the plurality of the unit cells in the first layer to one point of a corresponding offset unit cell of the plurality of the unit cells in the second layer.

6. The assembly of claim 1, wherein one or two anchoring members of the plurality of anchoring members connect two opposed points in one of the plurality of the unit cells in the second layer to one point of a corresponding offset unit cell of the plurality of the unit cells in the first layer.

7. The assembly of claim 1, wherein each anchoring member of the plurality of the anchoring members is connected to other anchoring members of the plurality of the anchoring members by means of joints.

8. The assembly of claim 1 wherein each element of the plurality of the slender structural support elements is connected to other slender structural support elements of the plurality of the slender structural support elements by means of joints.

9. The assembly of claim 1, wherein the plurality of the slender structural support elements is connected to the plurality of the anchoring members by means of joints.

10. The assembly of claim 1, wherein each of the plurality of unit cells is foldable against the first central axis and/or the second central axis.

11. The assembly of claim 1, wherein each unit cell of the plurality of unit cells has a similar size of other unit cells of the plurality of unit cells.

12. The assembly of claim 1, wherein the plurality of unit cells has different sizes.

13. The assembly of claim 1, wherein each unit cell of the plurality of the unit cells has a similar shape of other unit cells of the plurality of unit cells.

14. The assembly of claim 1, wherein each unit cell of the plurality of the unit cells has a different shape than other unit cells of the plurality of unit cells.

15. The assembly of claim 1, wherein the plurality of slender structural support elements is hollow.

16. The assembly of claim 1, wherein the plurality of slender structural support elements is solid.

17. The assembly of claim 1, wherein the plurality of anchoring members is hollow.

18. The assembly of claim 1, wherein the plurality of anchoring members is solid.

19. The assembly of claim 1, wherein the plurality of slender structural support elements is made of a rigid material, a flexible material, or a combination thereof.

20. The assembly of claim 19, wherein the plurality of slender structural support elements is made of a metal, plastic, bamboo, wood, fiberglass, carbon fiber, or combinations thereof.

21. The assembly of claim 1, wherein the plurality of anchoring members is made of a rigid material, a flexible material, or a combination thereof.

22. The assembly of claim 21, wherein the plurality of anchoring members is made of a metal, plastic, bamboo, wood, fiberglass, carbon fiber, or combinations thereof.

23. The assembly of claim 1, wherein the fabric is made of a man-made industrial material, a natural composite material, or a combination thereof.

24. The assembly of claim 23, wherein the natural composite material is made of an animal source, or a plant source, or combinations thereof.

25. The assembly of claim 24, wherein the natural composite material is made of goat hair, wool, jute, flax, hemp, felt, cotton, or combinations thereof.

26. The assembly of claim 23, wherein the man-made industrial material is made of polyurethane-coated lycra, polyurethane coated spandex, ripstop nylon, polypropylene, graphene, synthetic fibers, Kevlar, polyester, plastic fibers, nylon, Cuben fiber, aramids, filament tape, or combinations thereof.

27. The assembly of claim 23, wherein the fabric is woven and/or knitted and/or spun and/or molded to provide a metamaterial capable of elastic deformation, or a non-stretchable material containing a multitude of patterns connected to each other.

28. The claim 1, wherein the plurality of slender structural support elements and the plurality of anchoring members bend take a shape of a predetermined patterned fabric.

29. The assembly of claim 1, wherein the horizontal offset displacement is parallel to either the first central axis or the second central axis.

* * * * *